US007958834B2

(12) United States Patent
Matsumoto et al.

(10) Patent No.: US 7,958,834 B2
(45) Date of Patent: Jun. 14, 2011

(54) TEMPLATE FOR USE IN CIRCULAR SEWING

(75) Inventors: Nobuaki Matsumoto, Nagoya (JP); Yasuhiro Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 430 days.

(21) Appl. No.: 12/230,162

(22) Filed: Aug. 25, 2008

(65) Prior Publication Data

US 2009/0126609 A1 May 21, 2009

(30) Foreign Application Priority Data

Nov. 19, 2007 (JP) ..... 2007-299323

(51) Int. Cl.
*D05B 35/00* (2006.01)
*A41H 1/00* (2006.01)

(52) U.S. Cl. ..... 112/470.17; 33/11

(58) Field of Classification Search ..... 112/78, 112/136, 475.08, 270, 470.17; 33/1 B, 1 G, 33/2 R, 11, 562–566
See application file for complete search history.

(56) References Cited

U.S. PATENT DOCUMENTS

| | | | | |
|---|---|---|---|---|
| 647,339 | A * | 4/1900 | Thompson | 33/1 N |
| 1,083,601 | A * | 1/1914 | Druckerman | 112/436 |
| 2,529,413 | A * | 11/1950 | Petersen | 434/83 |
| 3,795,053 | A * | 3/1974 | Burke | 33/1 B |
| 4,762,076 | A | 8/1988 | Wakaizumi | |
| 6,860,211 | B2 * | 3/2005 | Valeriote et al. | 112/117 |
| 6,925,724 | B2 | 8/2005 | Tandy | |
| 7,255,051 | B2 | 8/2007 | Graham et al. | |
| 7,527,005 | B2 * | 5/2009 | Matsumoto et al. | 112/470.17 |
| 2005/0252019 | A1 * | 11/2005 | Gordon et al. | 33/566 |

FOREIGN PATENT DOCUMENTS

| | | | |
|---|---|---|---|
| JP | 61-013589 | Y2 | 4/1986 |
| JP | A-62-027995 | | 2/1987 |
| JP | 04-007198 | Y2 | 2/1992 |
| JP | A-04-073809 | | 3/1992 |
| JP | 07-028691 | U | 5/1995 |
| JP | A-08-057174 | | 3/1996 |
| JP | 2573404 | B2 | 10/1996 |
| JP | A-2002-066181 | | 3/2002 |
| JP | A-2004-510511 | | 4/2004 |
| JP | A-2005-504894 | | 2/2005 |
| JP | A-2008-253725 | | 10/2008 |
| WO | WO 02/29147 | A1 | 4/2002 |
| WO | WO 03/004749 | A1 | 1/2003 |

* cited by examiner

*Primary Examiner* — Ismael Izaguirre
(74) *Attorney, Agent, or Firm* — Oliff & Berridge, PLC

(57) ABSTRACT

A template for circular sewing is used for repeatedly sewing a single pattern into a circular arrangement with use of a sewing machine equipped with a circular sewing device. The template includes a transparent sheet member having a center point, a plurality of arc-shaped base lines arranged in a concentric pattern about the center point of the sheet member, and a plurality of linear pattern pitch measurement lines which are provided for measuring a pitch of the patterns and which are arranged on the sheet member so as to pass through the center point of the sheet member and across the arc-shaped base lines. A total number of patterns is indicated near to an end of the template. The total number of patterns is obtained when a pattern with a pitch substantially coinciding with one of the pattern pitch measurement lines has been sewn into a circular arrangement.

4 Claims, 8 Drawing Sheets

TEMPLATE FOR USE IN CIRCULAR SEWING

CROSS-REFERENCE TO RELATED APPLICATIONS

This application is based on and claims the benefit of priority from the prior Japanese Patent Application No. 2007-299323, filed on Nov. 19, 2007, the entire contents of which are incorporated herein by reference.

BACKGROUND

1. Field

The present disclosure relates to a template which is used in circular sewing with a sewing machine provided with a circular sewing device in order that a single pattern such as embroidery may repeatedly be formed into a circular arrangement.

2. Related Art

Conventional sewing machines which are capable of selecting one of a plurality of patterns and sewing the selected pattern include a type that can carry out a circular sewing in which a selected pattern is repeatedly sewn into a circular arrangement. Cloth on which the circular sewing is to be carried out is locked at a point by a lock pin. The selected pattern is repeatedly sewn at a number of times while the cloth is being rotated about a lock point. As a result, the selected pattern is repeatedly sewn along a circumference of a circle having a radius r equal to a distance from the lock point A1 to a sewing needle as shown in FIG. 9, for example.

In execution of the above-described circular sewing, it is desirable that a sewing start position of a first sewn pattern should coincide with a sewing end position of a last sewn pattern. However, as shown in FIG. 10, a sewing start position A2 of the first sewn pattern does not sometimes coincide with a sewing end position A3 of the last sewn pattern, whereupon the sewn pattern looks unattractive. In order that a sewing start position of a first sewn pattern may coincide with a sewing end position of a last sewn pattern, a trial sewing is conventionally carried out many times while one or more of parameters including the length, feed pitch and radius of the pattern are changed from one to another. However, this solving manner results in a problem that a large amount of work and a large amount of cloth and thread are wasted.

In view of the foregoing problem, Japanese Patent No. 2573404 discloses a circular sewing method and device in each of which a circumference is obtained from a distance between a lock point of cloth and a needle (a radius in the circular sewing). When the obtained circumference is divided by a length of a pattern and the resultant quotient is not an integer, the length of at least one of the circularly arranged patterns is corrected so that an excess or deficiency is absorbed, whereby a sewing start position of a first sewn pattern coincides with a sewing end position of a last sewn pattern.

In order that the above-mentioned positional coincidence may be achieved in execution of circular sewing in the foregoing Japanese Patent, the sewing machine needs to be provided with computing functions of obtaining the circumference from the distance between the lock point of the cloth and the needle, dividing the circumference by the length of the selected pattern, and correcting the length of at least one pattern when the quotient is not an integer. These computing functions increase costs of the sewing machine.

SUMMARY

Therefore, an object of the present disclosure is to provide a template for circular sewing which has a simpler configuration and yet can provide an easier determination as to whether a sewing start position of a first sewn pattern coincides with a sewing end position of a last sewn pattern, and which can prevent the costs of the sewing machine from being increased.

The present disclosure provides a template for circular sewing, which is used for repeatedly sewing a single pattern into a circular arrangement with use of a sewing machine provided with a circular sewing device, the template comprising a transparent sheet member having a center point, a plurality of arc-shaped base lines arranged in a concentric pattern about the center point of the sheet member, and a plurality of linear pattern pitch measurement lines which are provided for measuring a pitch of the patterns and which are arranged on the sheet member so as to pass through the center point of the sheet member and across the arc-shaped base lines, the template having an end located outside the pattern pitch measurement lines, wherein a total number of patterns is indicated near to the end, said total number of patterns being obtained when a pattern with a pitch substantially coinciding with one of the pattern pitch measurement lines has been sewn into a circular arrangement.

In use of the above-described template, a trial sewing is firstly carried out using the sewing machine and the circular sewing device. In the trial sewing, a single pattern desired to be sewn by the circular sewing is sewn with a radius of circular arrangement about a lock point on trial. The center point of the template is placed upon the lock point of the pattern sewn on trial. In this state, a reference line which is one of the pattern pitch measurement lines is placed upon a sewing start position of the pattern so that an inquiry is made as to where a sewing end position of the pattern is located on the template. When the sewing end position of the pattern is placed upon one of the pattern pitch measurement lines, it can be determined that a sewing start position of a first sewn pattern coincides with a sewing end position of a last sewn pattern in the case where the pattern having sewn on trial is repeatedly sewn by the circular sewing.

On the other hand, when a sewing end position of the pattern is not placed upon any one of the pattern pitch measurement lines, it can be determined that a sewing start position of a first sewn pattern does not coincide with a sewing end position of a last sewn pattern in the case where the pattern having sewn on trial is repeatedly sewn by the circular sewing. The length of the pattern is adjusted in this case and the trial sewing is carried out again. Thereafter, an inquiry is made with use of the template as to where a sewing end position of the pattern is located on the template.

According to the above-described template, the reference line of the pattern pitch measurement lines is caused to be placed upon a sewing start position under the condition where the center point of the template is placed upon the lock point of the pattern sewn on trial. Thus, an inquiry is made as to where a sewing end position of the pattern is located on the template, whereby it can be easily determined whether a sewing start position of a first sewn pattern coincides with a sewing end position of a last sewn pattern. In this case, the circular sewing template comprises a transparent sheet member which has a plurality of arc-shaped base lines and a plurality of pattern pitch measurement lines. Thus, the template has a simpler construction. Furthermore, the above-described template can prevent the costs of the sewing machine from being increased, differing from the conventional template in which the sewing machine needs to be provided with the computing functions in order that a sewing start position of a first sewn pattern may be caused to coincide with a sewing end position of a last sewn pattern.

In another embodiment, the template further comprises a plurality of through holes which are located on at least one of the pattern pitch measurement lines and further at the center point and a plurality of intersections where the pattern pitch measurement lines and the arc-shaped base lines intersect each other.

According to the embodiment, the template can be used in the following manner. The template is placed on cloth to be processed so that a needle is inserted through the through hole located at the center point of the template thereby to lock the cloth. A distal end of writing material such as pen is inserted into a desired one of the through holes located at a plurality of intersections where the pattern pitch measurement line and the arc-shaped base lines intersect each other. When the template is then turned about the aforesaid center point or lock point, a circle can easily be drawn on the cloth by the writing material. When the drawn circle is cut out by a cutting tool such as scissors, a circular cloth can easily be made.

BRIEF DESCRIPTION OF THE DRAWINGS

Other objects, features and advantages of the present disclosure will become clear upon reviewing the following description of one embodiment with reference to the accompanying drawings, in which.

DETAILED DESCRIPTION

Figure 1:
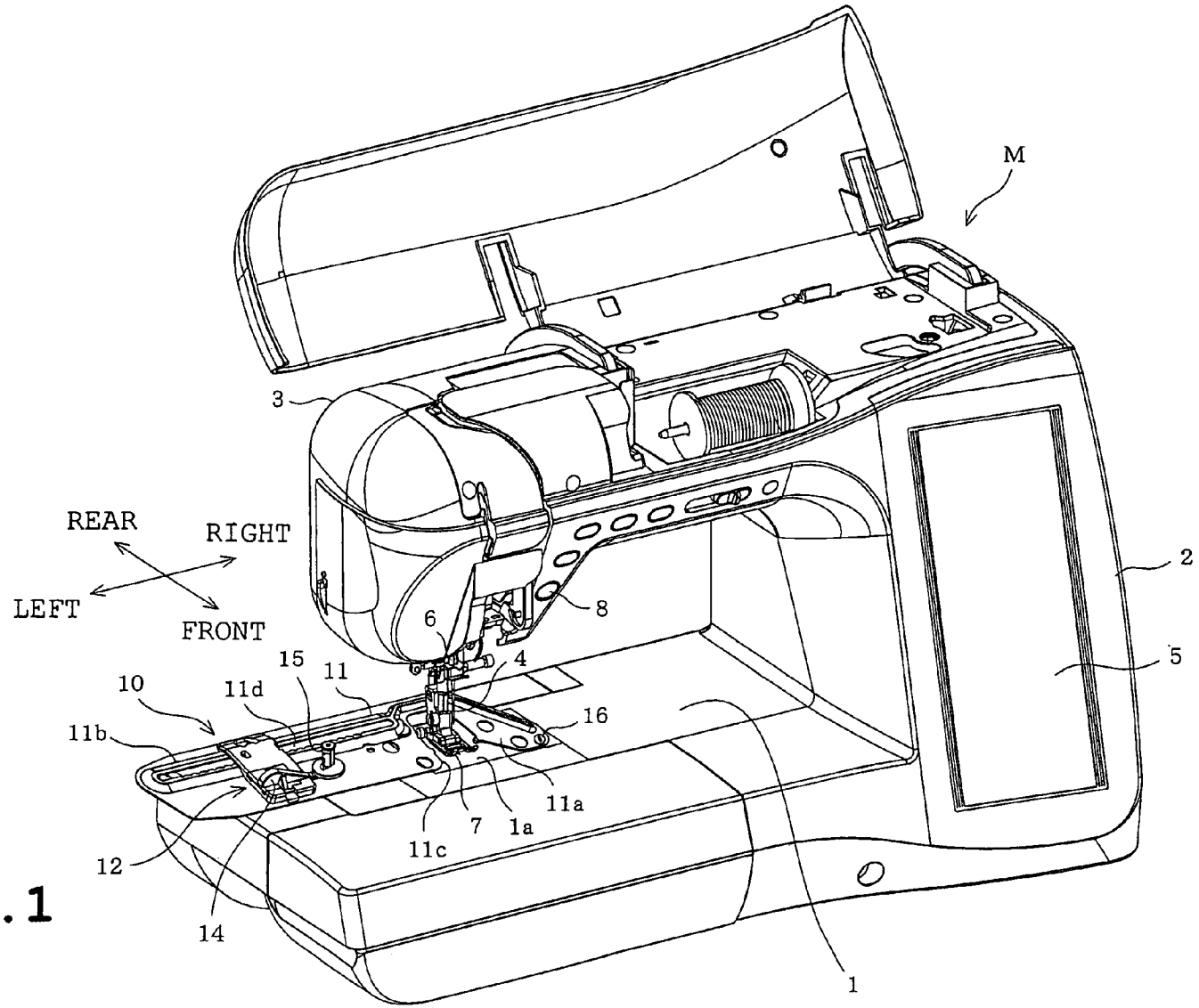
FIG. 1 is a perspective view of an electronically controlled sewing machine to which a circular sewing device is attached.
Figure 10:
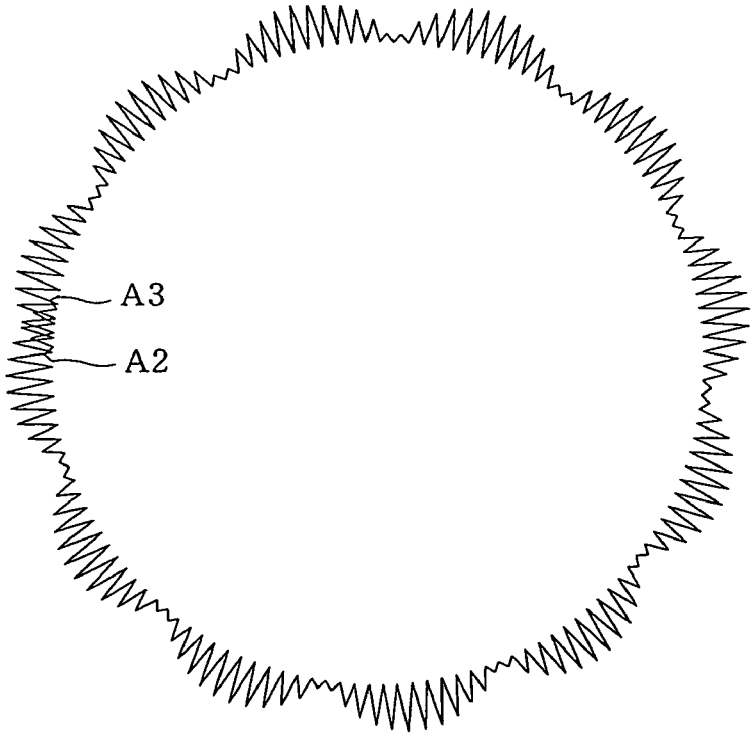
FIG. 10 shows another example in which a sewing start position of a first sewn pattern is not coincident with a sewing end position of a last sewn pattern.

One embodiment will be described with reference to FIGS. 1 to 8D. Referring first to FIG. 1, an electronically controlled sewing machine M is shown. A circular sewing device 10 which will be described later is attached to the sewing machine M. The electronically controlled sewing machine M includes a bed 1, a pillar 2 standing upward from a right end of the bed 1 and an arm 3 extending leftward from an upper end of the pillar 2 so as to be opposed to the bed 1 as shown in FIG. 10. A needle plate 1*a* is mounted on an upper surface of the bed 1. Below the needle plate 1*a* are provided a feed dog vertically moving mechanism (not shown) vertically moving a feed dog (not shown) which feeds workpiece cloth to be processed, a feed dog horizontally moving mechanism (not shown) horizontally moving the feed dog, a full rotary hook which accommodates a bobbin (not shown) on which a bobbin thread is wound and forms stitches in cooperation with a needle 4, and a thread cutting mechanism (not shown) cutting a both needle thread and a bobbin thread.

A large-size color liquid-crystal display 5 is mounted on a front surface of the pillar 2. A menu screen, a pattern input screen, a pattern selecting screen and the like are displayed on the display 5. Inside the arm 3 are provided a main shaft (not shown) which is driven by a sewing machine motor (not shown) and is mounted so as to extend in the right-left direction, a needlebar drive mechanism (not shown) which vertically moves a needlebar 6 having a lower end to which a needle 4 is mounted, a needlebar swinging mechanism (not shown) which swings the needlebar 6 in the direction intersecting a cloth feed direction, a needle thread take-up drive mechanism which vertically moves a needle thread take-up (not shown) in synchronization with the vertical movement of the needlebar 6 and the like. A cloth presser 7 is provided near the needle 4 for pressing the workpiece cloth from upward. Various switches including a start/stop switch 8 instructing start and stop of a sewing operation are provided on the front surface of the arm 3. A circular sewing device 10 for carrying out a circular sewing is attached to an upper surface of the needle plate 1*a*.

Figure 2C:
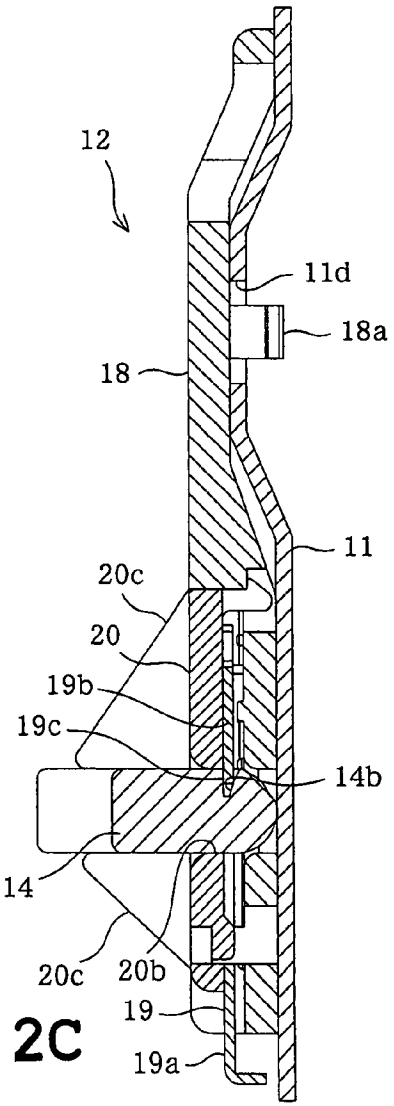
FIG. 2C is an enlarged section taken along line IIC-IIC in FIG. 2A.
Figure 2B:
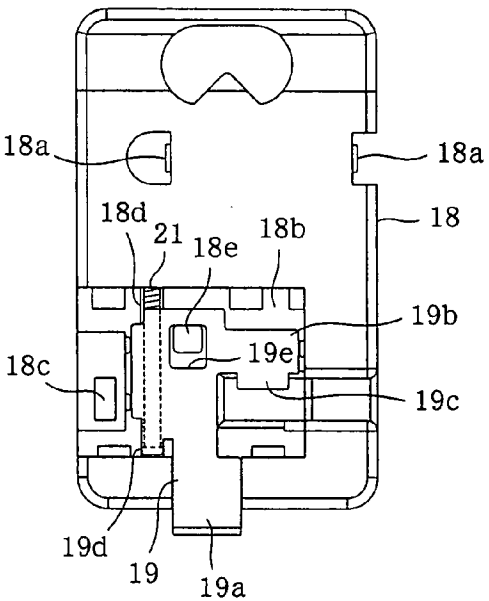
FIG. 2B is also a plan view of the circular sewing device with an upper holder and the cloth-fixing needle being eliminated.
Figure 2A:
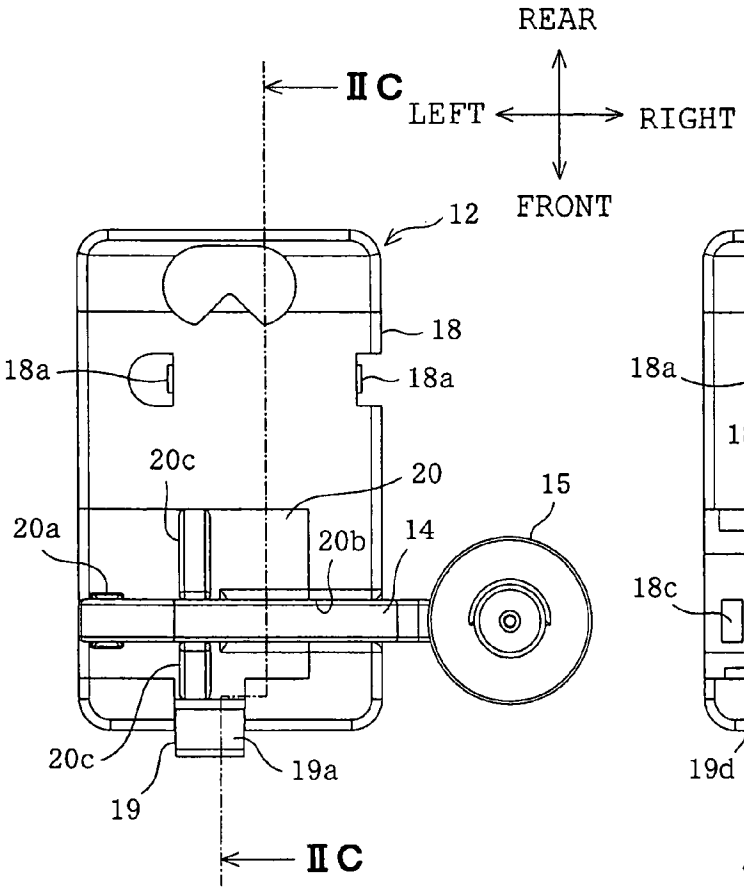
FIG. 2A is a plan view of the circular sewing device, showing the state where a cloth-fixing needle is attached to a cloth needle support of the circular sewing device.

The circular sewing device 10 will now be described with reference to FIGS. 2A to 3 together with FIG. 1. The circular sewing device 10 comprises a body base 11 (see FIG. 1) detachably attached to an upper surface of the needle plate 1*a*, a cloth needle support 12 (see FIGS. 2A to 2C and 3) movably mounted on the body base 11, a cloth fixing needle 14 having a cloth needle 13 (see FIG. 3) and detachably attached to the cloth needle support 12, and a needle cap 15 (see FIG. 1) detachably fitted with the cloth needle 13. The body base 11 comprises amount 11*a* fixedly mounted to the needle plate 1*a* by a screw 16 and a guide 11*b* extending linearly from the mount 11*a* leftward in FIG. 1. The mount 11*a* and the guide 11*b* are formed integrally with each other. The mount 11*a* is formed with an opening 11*c* open at the front side. The aforesaid cloth presser 7 is disposed in the opening 11*c*. The guide 11*b* has a linear rail groove 11*d* extending in the right-left direction. The rail groove 11*d* has a plurality of V-shaped grooves formed in one side thereof at predetermined intervals (5 mm, for example).

Figure 3:
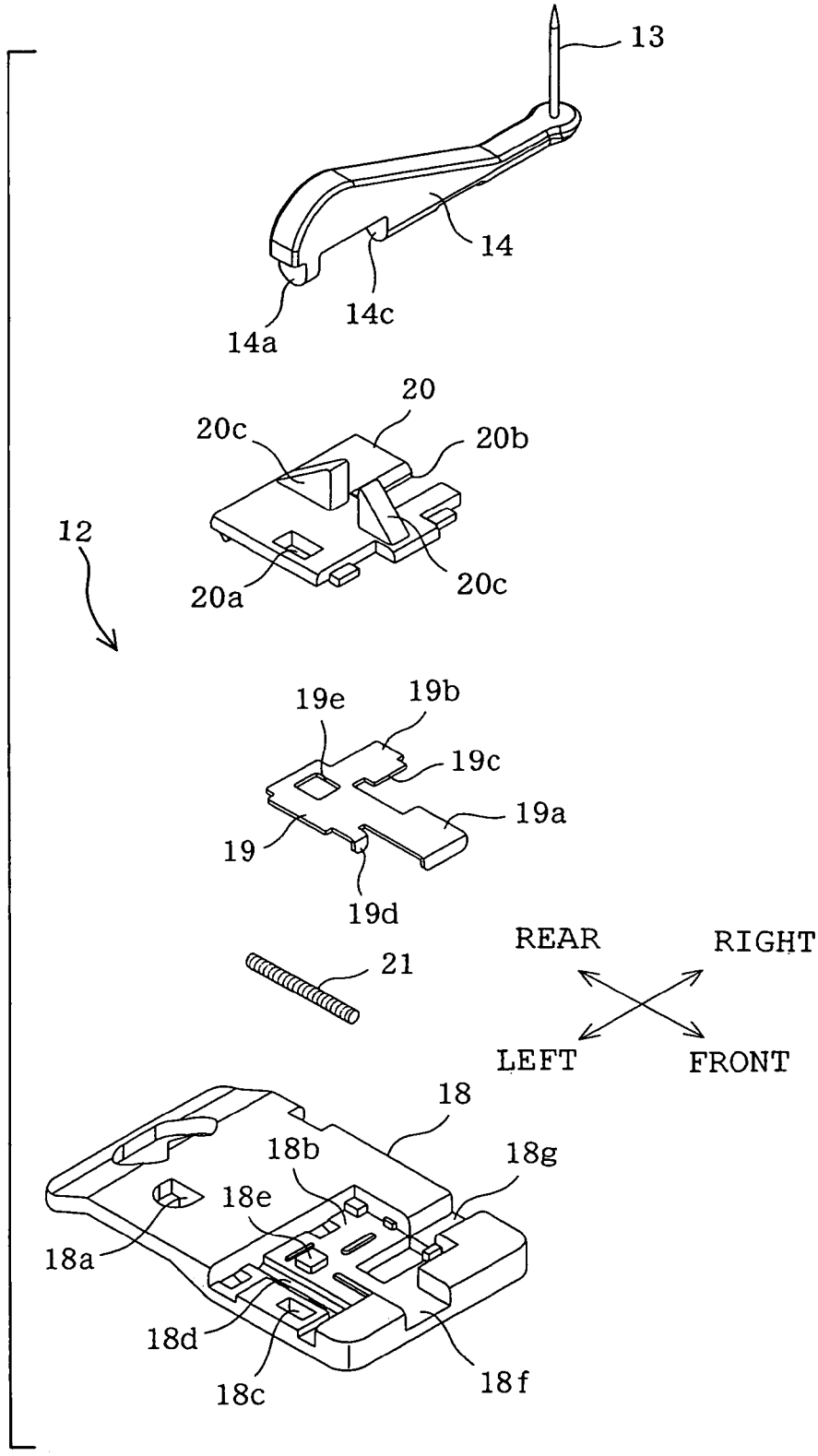
FIG. 3 is an exploded perspective view of the cloth needle support and the cloth-fixing needle of the circular sewing device.

Referring to FIG. 3, the cloth needle support 12 comprises a lower holder 18, an operation plate 19 which is slidably disposed so as to be slidable in the back-forth direction relative to the lower holder 18, an upper holder 20 which is disposed so as to cover the operation plate 19 from above, and a compression coil spring 21 which is long in the back-forth direction. The lower holder 18 is formed into a generally rectangular shape and has two engagement portions 18*a* which are provided on a rear part thereof so as to protrude to the back side. The engagement portions 18*a* are engageable with the rail groove 11*d*. The lower holder 18 is movable along the rail groove 11*d* in the right-left direction, so that the lower holder 18 is held at a suitable position when the engagement portion 18*a* engages the rail groove 11*d*. Furthermore, when the lower holder 18 is moved in the right-left direction, the engagement portion 18*a* is intermittently engaged with the V-shaped grooves, whereby a light clicking sound or notch feeling is given. A front upper surface of the lower holder 18 is formed with a recess 18*b* provided for assembling the operation plate 19 and the upper holder 20 to the lower holder 18. The recess 18*b* has a left end formed with a fitting hole 18*c* into which a fitting protrusion 14*a* is fitted as will be described later. A spring cavity 18*d* is defined on the right of the fitting hole 18*c*. The compression coil spring 21 is accommodated in the spring cavity 18*d*. A rectangular guide protrusion 18*e* is provided on the right of the spring cavity 18*d*.

A recessed operation plate support 18*f* is formed in a front portion of the recess 18*b* in the lower holder 18. An operating portion 19*a* of the operation plate 19 is guided by the operation plate support 18*f* so as to be movable in the back-forth direction. A recessed cloth fixing needle support 18*g* is formed on the right of the recess 18*b* in the lower holder 18. The right portion of the cloth fixing needle 14 is supported by the cloth fixing needle support 18*g*. Both supports 18*f* and 18*g* communicate with the recess 18*b*. The operation plate 19 is formed substantially into an L-shape and includes the operating portion 19*a* extending in the back-forth direction and an engaged portion 19*b* protruding rightward from a rear end of the operating portion 19*a*. The engaged portion 19*b* has a front end formed with an engagement claw 19*c* brought into engagement with an engagement groove 14*b* (see FIG. 2C) of the cloth fixing needle 14 as will be described later. The operation plate 19 includes a spring shoe 19*d* which is located on the left of the operating portion 19*a* and is bent downward. The spring shoe 19*d* is inserted into a front portion of the spring cavity 18*d*.

The aforesaid compression coil spring 21 has front and rear ends. When the spring 21 is accommodated in the spring cavity 18*d*, the front end of the spring 21 is in abutment with a rear surface of the spring shoe 19*d*, whereas the rear end of the spring 21 is in abutment with a rear wall of the spring cavity 18*d*. The operation plate 19 is biased forward by a spring force of the spring 21. The operation plate 19 has a rectangular guide hole 19*e* formed in the rear portion thereof. The guide protrusion 18*e* of the lower holder 18 is fitted into the guide hole 19*e*. The guide hole 19*e* is formed so that a dimension thereof in the back-forth direction is longer than a dimension of the guide protrusion 18*e* in the back-forth direction. The operation plate 19 is movable in the back-forth direction by the difference between these dimensions (see FIG. 2B).

The upper holder 20 is fitted into the recess 18*b* of the lower holder 18 while the operation plate 19 is interposed therebetween so as to be movable in the back-forth direction. The upper holder 20 includes a left portion formed with a fitting hole 20*a* corresponding to the fitting hole 18*c* of the lower holder 18. The upper holder 20 further includes a right portion formed with an opening 20*b* whose right side is open. The upper holder 20 has two cloth slide portions 20*c* opposed to each other in the back-forth direction. Each cloth slide portion 20*c* is triangular in shape as viewed at a side thereof.

The cloth fixing needle 14 extends in the right-left direction and has a right end which has a lower thickness than any other part thereof. An upper surface of the right end is horizontal. The cloth needle 13 is fixed to the right end of the cloth fixing needle 14 with a distal end thereof being directed upwardly. The cloth fixing needle 14 further has a left portion formed into such an inclined shape that the thickness thereof is gradually increased as the cloth fixing needle 15 goes to the left. The cloth needle plate 22 has a left end formed into a curved or downwardly convex shape and an underside with a notch 14*c* which is assembled to the cloth needle support 12. The aforesaid fitting protrusion 14*a* is formed immediately on the left of the notch 14*c*. The cloth fixing needle 14 has an engagement groove 14*b* formed in a rear-side portion on the right of the notch 14*c* in the cloth fixing needle 14 as shown in FIG. 2C. The engagement claw 19*c* of the operation plate 19 engages the engagement groove 14*b*. The cloth fixing needle 14 has a width that is set so that front and rear surfaces of the cloth fixing needle 14 abut against opposed inner surfaces of the cloth slide portions 20*c* respectively.

The assembling of the cloth fixing needle 14 to the cloth needle support 12 will now be described. When the distal end of the cloth needle 13 is directed upward, the fitting protrusion 14*a* is fitted in turn into the fitting holes 20*a* and 18*c* of the upper and lower holders 20 and 18 respectively, and a right lower portion is fitted into the opening 20*b* of the upper holder 20. In this case, the engagement claw 19*c* of the operation plate 19 is engaged with the engagement groove 14*b* of the cloth fixing needle 14 (see FIG. 2C), whereupon the cloth fixing needle 14 is prevented from falling off upward. Furthermore, the bottom of the notch 14*c* abuts against the upper surface of the upper holder 20. The front and rear surfaces of the cloth fixing needle 14 abut against opposed inner surfaces of the cloth slide portions 20*c* respectively. As a result, the cloth fixing needle 14 is supported so as to be prevented from falling down.

Additionally, when the cloth fixing needle 14 is to be detached from the cloth needle support 12, the operating portion 19*a* of the operation plate 19 is pressed backward against the biasing force of the spring 21, so that the operation plate 19 is moved backward. The engagement claw 19*c* is then detached rearward from the engagement groove 14*b* thereby to be released from the engagement with the engagement groove 14*b*. When lifted upward in this state, the cloth fixing needle 14 can be detached from the cloth needle support 12.

The following will describe a manner of circular sewing by use of the circular sewing device 10. The body base 11 of the circular sewing device 10 is fixed to the upper surface of the needle plate 1*a* of the bed 1 as shown in FIG. 1. The operation plate 19 is then operated so that the cloth fixing needle 14 is detached from the cloth needle support 12. Subsequently, the needle cap 15 is detached from the cloth-needle 13. The cloth needle 13 is then inserted through workpiece cloth (not shown) to be processed so as to assume a position that is a center of central sewing. The needle cap 15 is re-attached to the distal end of cloth needle 13 extending through the workpiece cloth. The cloth needle support 12 is then slid in the back-forth direction relative to the guide portion 11*b* of the body base 11 thereby to be set at a desired position. Thereafter, the cloth fixing needle 14 retained on the workpiece cloth is attached to the cloth needle support 12.

Figure 9:
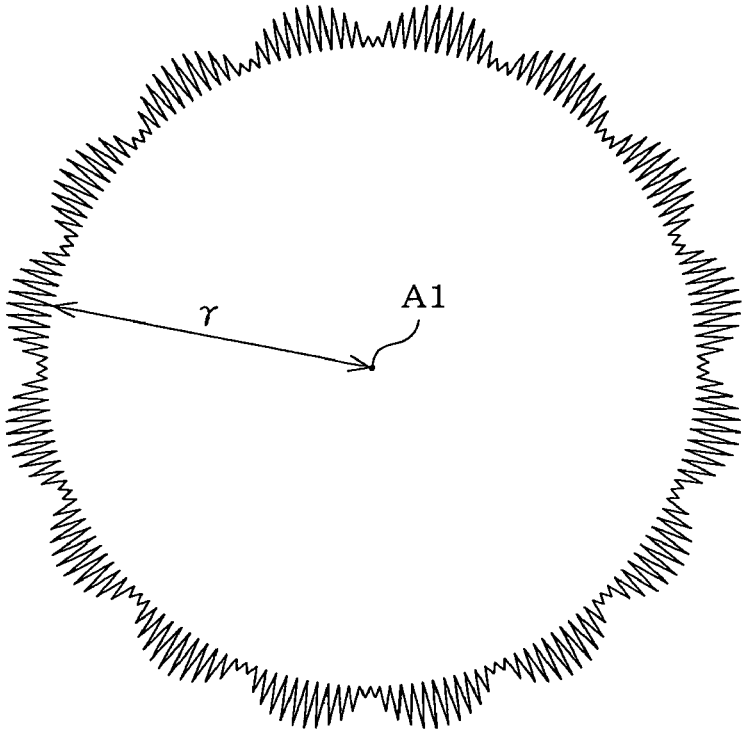
FIG. 9 shows an example of circular sewing.

Subsequently, after the start switch 8 of the electronically controlled sewing machine M has been operated, a pattern desired to be sewn is selected and the circular sewing is started. The selected pattern is repeatedly sewn on the workpiece cloth while the workpiece cloth is turned about the cloth needle 13 (the lock point) inserted through the workpiece cloth. As a result, the pattern is repeatedly sewn so as to form a circle along a circumference of a circle with a radius equal to the distance between the cloth needle 13 (the lock point) and the sewing needle 4 (see FIG. 9).

Figure 4:
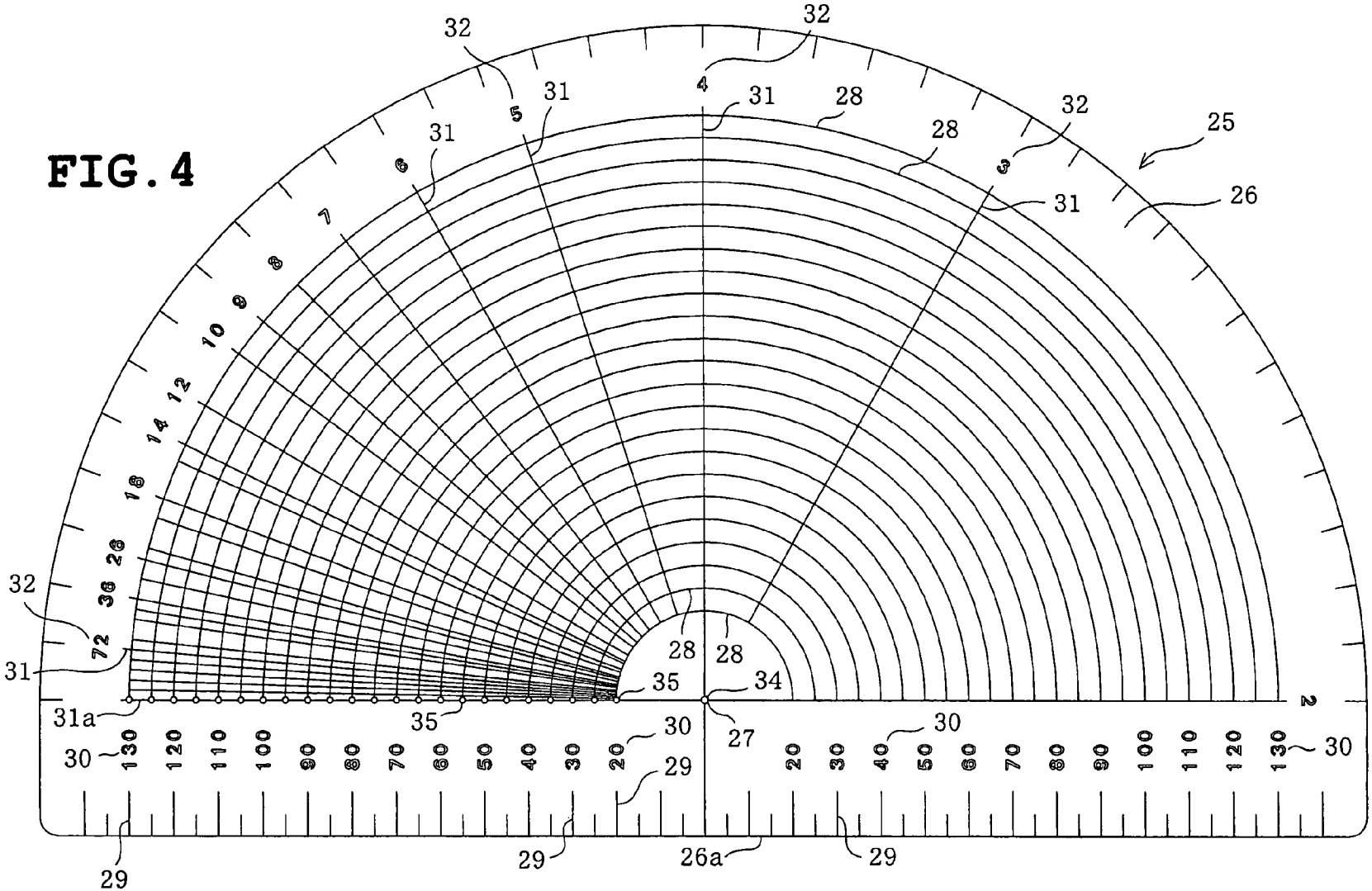
FIG. 4 is a plan view of a circular sewing template of one embodiment in accordance with the present disclosure.

The circular sewing template of the embodiment is used when it is desirable that a sewing start position of a first sewn pattern should coincide with a sewing end position of a last sewn pattern in execution of the circular sewing as described above. Accordingly, the circular sewing template will be described with reference to FIGS. 4 to 6. FIG. 4 is a plan view of the circular sewing template 25 of the embodiment. The circular sewing template 25 comprises a transparent semicircular sheet member 26 provided with a number of lines which will be described later. The sheet member 26 has a center point 27 set near a semicircular chord equivalent 26*a*. A plurality of arc-shaped base lines 28 is arranged in a concentric manner about the center point 27 on the sheet member 26. The base lines 28 are arranged at a predetermined interval, for example, at an interval of 5 mm. The interval is equal to the predetermined interval at which the V-shaped grooves of the rail groove 11*d* are formed. On the sheet member 26 are provided radius scales 29 indicative of the distance from the center point 27 and numerals 30 indicative of radii. The radius scales 29 and the numerals 30 are located near the semicircular chord equivalent 26*a*.

A plurality of linear pattern pitch measurement lines 31 is provided on the sheet member 26. The pattern pitch measurement lines 31 are arranged so as to pass through the center point 27 and so as to cross the arc-shaped base lines 28. The pattern pitch measurement lines 31 include a left-hand one which is located at the side of radius-indicative numeral 30 and serves as a reference line 31*a* of the pattern pitch measurement lines 31. The reference line 31*a* is disposed in parallel with the chord equivalent 26*a*. The pattern pitch measurement lines 31 other than the reference line 31*a* are arranged at an interval of an angle obtained by dividing 360° by an integer. Bold numerals as designated by reference numerals 32 are provided near outer ends of the plural pattern pitch measurement lines 28 on the template 25 respectively. Each bold numeral 32 indicates a total number of sewn patterns which are circularly arranged with pitches substantially coincident with the corresponding pattern pitch measurement line 31.

The pattern pitch measurement line 31 corresponding to bold numeral "3" designated by the total pattern number 32 forms an angle of 120 degrees with the reference line 31*a*. Similarly, the pattern pitch measurement line 31 corresponding to bold numeral "4" designated by the total pattern number 32 forms an angle of 90 degrees with the reference line 31*a*. The pattern pitch measurement line 31 corresponding to bold numeral "5" designated by the total pattern number 32 forms an angle of 72 degrees with the reference line 31*a*. The pattern pitch measurement line 31 corresponding to bold numeral "6" designated by the total pattern number 32 forms an angle of 60 degrees with the reference line 31*a*. At least one pattern pitch measurement line 31 or more specifically, the reference line 31*a* has a through hole 34 which is formed thereon so as to correspond to the center point 27. The reference line 31*a* also has a number of through holes 35 which are formed thereon so as to correspond to intersection points of the arc-shaped base lines 28 and the reference line 31*a* respectively.

A manner of using the template 25 thus configured will now be described. Firstly, a trial sewing is carried out on a trial sewing cloth (not shown) using the electronically controlled sewing machine M and the circular sewing device 10. In the trial sewing, a pattern desired to be sewn with a radius about the cloth needle 13 (the lock point) is sewn at a single time by way of trial. The cloth on which the pattern has been sewn by way of trial is detached from the circular sewing device 10, and the cloth fixing needle 14 is detached from the cloth. The circular sewing template 25 is put onto the cloth. As shown in FIG. 5A, the center point 27 of the template 25 is placed upon the lock point K through which the cloth needle 13 has been inserted and which serves as a center of a radius of the pattern B on which the trial sewing has been carried out. In this state, the reference line 31*a* of the pattern pitch measurement line 31 is placed upon a sewing start point B1 of the pattern B.

The user then finds out where a sewing end position B2 of the pattern B is located on the template 25. In this case, when the sewing end position B2 of the pattern B is not placed upon any pattern pitch measurement line 31 as shown in FIG. 5A, it can be determined that a sewing start position of a first sewn pattern does not coincide with a sewing end position of a last sewn pattern when the circular sewing is carried out by repeatedly sewing the pattern B which has been sewn by way of trial. In this instance, the length of the pattern is adjusted and trial sewing is carried out again. Subsequently, the user again finds out where a sewing end position B2 of the pattern B is located on the template 25.

Figure 5B:
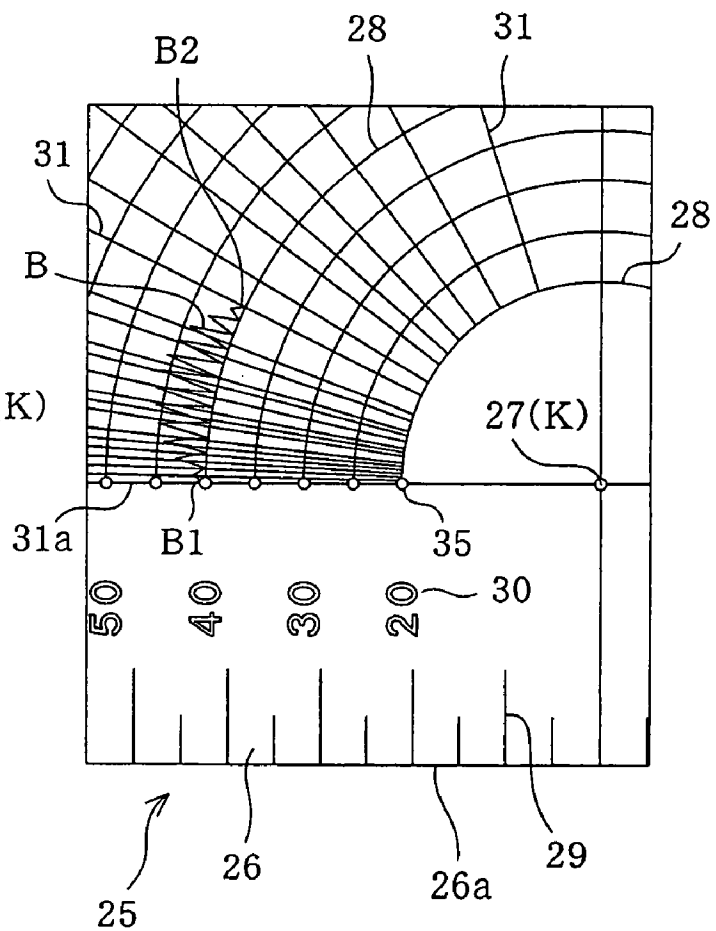
FIG. 5B is a partial plan view of the template, showing a usage example of the template in which a sewing end position of the pattern sewn on trial is coincident with one of the pattern pitch measurement lines.
Figure 5A:
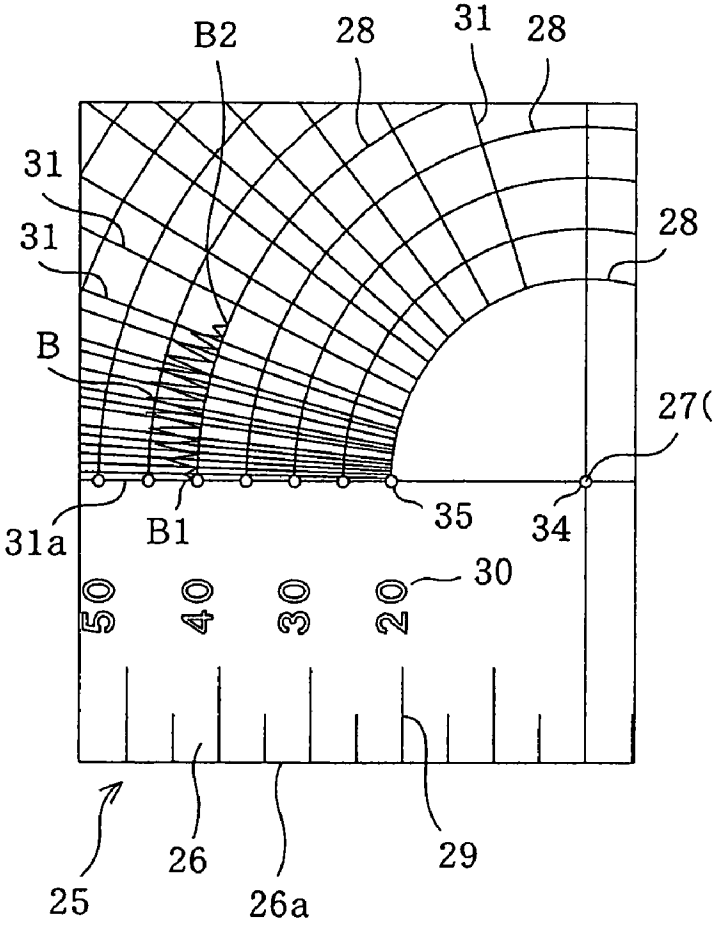
FIG. 5A is a partial plan view of the template, showing a usage example of the template in which a sewing end position of the pattern sewn on trial is not coincident with any one of pattern pitch measurement lines.
Figure 6:
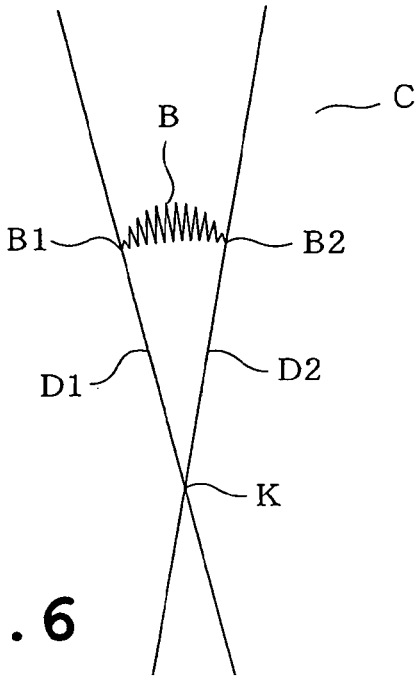
FIG. 6 is a plan view of the template, showing straight lines drawn from the lock point to the sewing start and end positions of the pattern sewn on trial.
Figure 7:
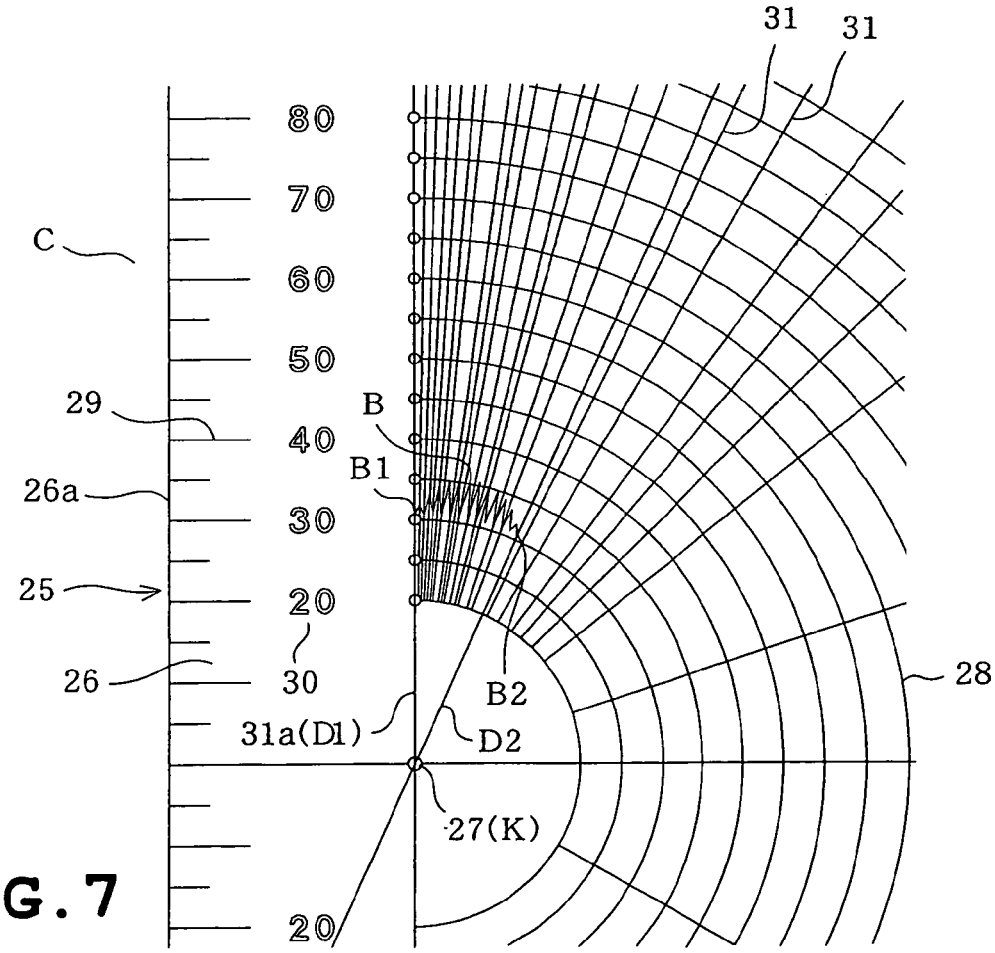
FIG. 7 is a partial plan view of the template, showing an example of usage of the template.

On the other hand, when the sewing end position B2 of the pattern B is placed upon one of the pattern pitch measurement lines 31 as shown in FIG. 5B, it can be determined that a sewing start position of a first sewn pattern coincides with a sewing end position of a last sewn pattern when the circular sewing is carried out by repeatedly sewing the pattern B which has been sewn by way of trial. Alternatively, based on a manner as shown in FIGS. 6 and 7, it can also be determined whether a sewing start position of a first sewn pattern coincides with a sewing end position of a last sewn pattern. More specifically, two straight lines D1 and D2 are drawn on cloth C on which one pattern B has been sewn by way of trial, using an air-soluble marker. The straight line D1 passes through a lock point K which is obtained when the pattern B is sewn and through which the cloth needle 13 has been inserted and a sewing start position B1 of the pattern B. The straight line D2 passes through the aforesaid lock point K and a sewing end position B2 of the pattern B.

Thereafter, the template 25 is placed on the cloth C as shown in FIG. 7, and the center point 27 of the template 25 is placed upon the lock point K which serves as the center of radius of the pattern B on which the trial sewing has been carried out. In this state, the reference line 31*a* of the pattern pitch measurement line 31 is placed upon the straight line D1 in the same manner as described above. The user finds out where the straight line D2 passing through the sewing end position B2 of the pattern B is located on the template 25. In this case, too, when the straight line D2 is placed upon one of the pattern pitch measurement lines 31, it can be determined that a sewing start position of a first sewn pattern coincides with a sewing end position of a last sewn pattern when the circular sewing is carried out by repeatedly sewing the pattern B which has been sewn by way of trial. However, when the straight line D2 is not placed upon any pattern pitch measurement line 31, it can be determined that a sewing start position of a first sewn pattern does not coincide with a sewing end position of a last sewn pattern when the circular sewing is carried out by repeatedly sewing the pattern B which has been sewn by way of trial.

Figure 8A:
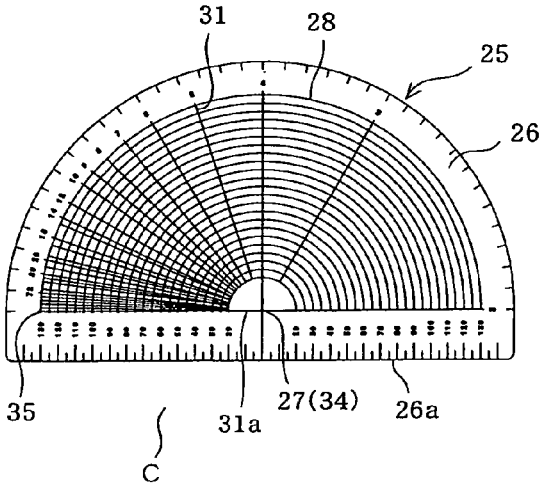
FIGS. 8A to 8D are plan views of the template, showing a case where a circle is drawn using the template.
Figure 8B:
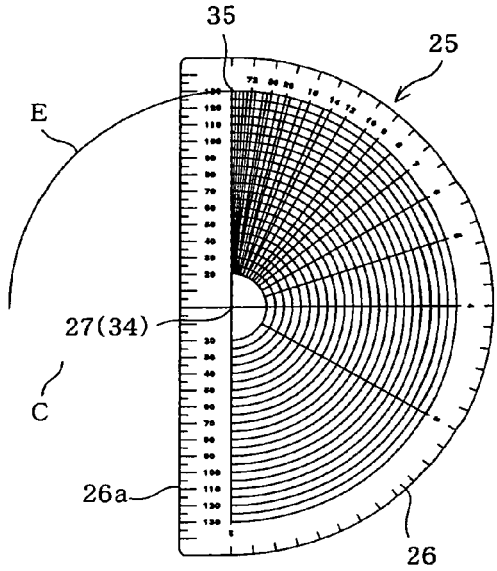
Figure 8C:
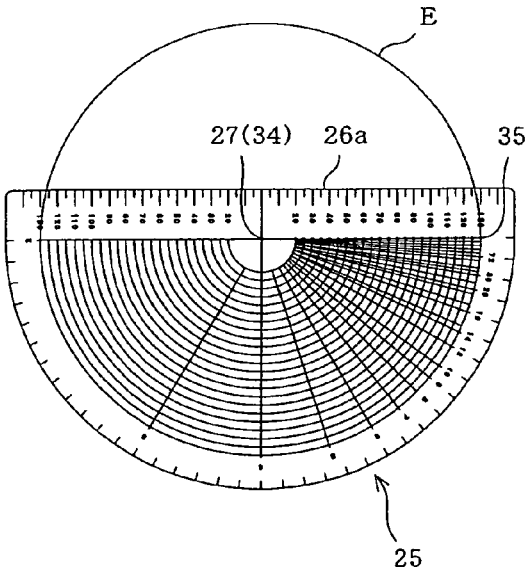
Figure 8D:
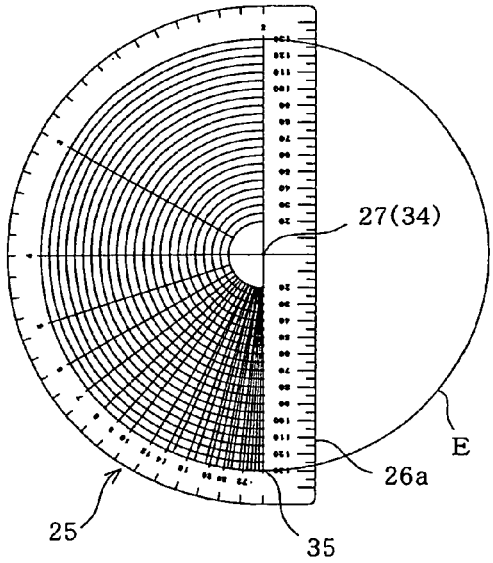

The template 25 of the embodiment can also be used in the following manner. The template 25 is placed on the cloth C to be processed as shown in FIG. 8A. A needle (not shown) or the like is inserted through the through hole 34 which is the center point 27 of the template 25, thereby locking the cloth C. The distal end of the air-soluble marker (not shown) is inserted through a desired one of the through holes 35 at the plural intersections of the pattern pitch measurement line 31 and the arc-shaped base lines 28. The template 25 is then turned one revolution about the center point 27 (the lock point) such that a circle E can be drawn on the cloth C with the air-soluble marker, as shown in FIGS. 8A to 8D. Thereafter, the cloth C is cut along the drawn circle E with a cutting tool (not shown) such as scissors, whereupon a circular cloth can be made easily.

The following advantages can be achieved from the template 25 of the embodiment. The center point 27 of the template 25 is placed upon the lock point K of the pattern B on which the trial circular sewing has been carried out. In this state, the reference line 31*a* of the pattern pitch measurement line 31 is placed upon the sewing start position B1 of the pattern B. When having found out where the sewing end position B2 of the pattern B is located on the template 25, the user can easily determine whether a sewing start position of a first sewn pattern coincides with a sewing end position of a last sewn pattern when the circular sewing is carried out. In this case, the template 25 comprises the transparent sheet member 26 provided with the plural arc-shaped base lines 28 and the plural pattern pitch measurement lines 31 and accordingly has a simpler configuration. Furthermore, differing from the conventional configuration necessitating the computing functions to be provided in the sewing machine, the template 25 of the embodiment can prevent the costs of the sewing machine from being increased.

The bold numerals designated by reference numerals 32 are provided near the outer ends of the pattern pitch measurement lines 31 on the template 25 respectively. Each numeral 32 indicates a total number of sewn patterns which are circularly arranged at pitches substantially conforming to the corresponding pattern pitch measurement line 31. Accordingly, when viewing the indicated total number 32 corresponding to the pattern pitch measurement line 31, the user can get the total number of patterns to be sewn by way of the circular sewing.

The arc-shaped base lines 28 are arranged at an interval of 5 mm which is the same as the intervals giving the notch feeling. Consequently, the usability of the template can be improved. Furthermore, since the radius scales 29 and the numeric values 30 of the radii are indicated on the template 25, these scales and numeric values are easy to understand and the template 25 is easy to use. Still furthermore, the needle or the like is inserted through the through hole 34 of the center point 27 thereby to lock the cloth C. In this state, the distal end of the air-soluble marker is inserted into the through hole at the intersection where the pattern pitch measurement line 31 and the arc-shaped base line 28 intersect each other. The template 25 is then rotated one revolution about the center point 27 (the lock point), whereby the circle E can be drawn on the cloth C. The cloth C is cut along the drawn circle E by the cutting tool such as scissors. As a result, the circular cloth can easily be made.

The invention should not be limited by the above-described embodiment. The embodiment can be modified or expanded as follows. The template 25 should not be limited to the semicircular shape but may have the shape of a circle or quarter circle. Additionally, the interval of the arc-shaped base lines 28 may include two types of numeric values, for example, an interval of 5 mm when the radius is less than 80 mm and an interval of 10 mm when the radius is not less than 80 mm.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A template for circular sewing, which is used for repeatedly sewing a single pattern into a circular arrangement with use of a sewing machine provided with a circular sewing device, the template comprising:

a transparent sheet member having a center point;

a plurality of arc-shaped base lines arranged in a concentric pattern about the center point of the sheet member; and a plurality of linear pattern pitch measurement lines which are provided for measuring a pitch of the patterns and which are arranged on the sheet member so as to pass through the center point of the sheet member and across the arc-shaped base lines, the template having an end located outside the pattern pitch measurement lines, wherein a total number of patterns is indicated near to the end, said total number of patterns being obtained when a pattern with a pitch substantially coinciding with one of the pattern pitch measurement lines has been sewn into a circular arrangement.

2. The template according to claim 1, wherein the pattern pitch measurement lines are arranged at every angle obtained by dividing 360 degrees by an integer.

3. The template according to claim 1, further comprising a plurality of through holes which is located on at least one of the pattern pitch measurement lines and further at the center point and a plurality of intersections where the pattern pitch measurement lines and the arc-shaped base lines intersect each other.

4. The template according to claim 1, wherein the arc-shaped base lines are arranged at predetermined intervals.

* * * * *